US010590668B2

(12) United States Patent
Tailly

(10) Patent No.: US 10,590,668 B2
(45) Date of Patent: Mar. 17, 2020

(54) POWERED TILE BREAKER

(71) Applicant: Richard Tailly, Yamaska (CA)

(72) Inventor: Richard Tailly, Yamaska (CA)

( * ) Notice: Subject to any disclaimer, the term of this patent is extended or adjusted under 35 U.S.C. 154(b) by 627 days.

(21) Appl. No.: 14/941,550

(22) Filed: Nov. 14, 2015

(65) Prior Publication Data

US 2017/0138072 A1 May 18, 2017

Related U.S. Application Data

(63) Continuation-in-part of application No. 13/935,488, filed on Jul. 4, 2013, now abandoned.

(51) Int. Cl.

| | |
|---|---|
| ***B28D 1/26*** | (2006.01) |
| ***E04G 23/00*** | (2006.01) |
| ***B28D 1/28*** | (2006.01) |
| ***B25D 11/00*** | (2006.01) |
| ***B25D 17/32*** | (2006.01) |

(52) U.S. Cl.

CPC ..... *E04G 23/006* (2013.01); *B25D 11/00* (2013.01); *B25D 17/32* (2013.01); *B28D 1/28* (2013.01); *B25D 2250/005* (2013.01)

(58) Field of Classification Search

CPC ..... E04G 23/006

See application file for complete search history.

(56) References Cited

U.S. PATENT DOCUMENTS

| | | | | |
|---|---|---|---|---|
| 2,197,154 | A | 4/1940 | Miller | |
| 2,519,138 | A | 8/1950 | Katz | |
| 3,376,071 | A | 4/1968 | Stein | |
| 3,779,605 | A | 12/1973 | Nieman | |
| 4,009,908 | A | 3/1977 | Alinder et al. | |
| 4,162,809 | A | 7/1979 | Anderson et al. | |
| 6,135,566 | A * | 10/2000 | Anderson | E04G 23/006 299/36.1 |
| 7,712,839 | B1 * | 5/2010 | Chen | E04G 23/006 15/93.1 |

FOREIGN PATENT DOCUMENTS

| | | | | |
|---|---|---|---|---|
| CA | 2819919 | A1 * | 1/2014 | B25D 17/32 |
| DE | 102011109285 | A1 * | 2/2013 | E04G 23/006 |

* cited by examiner

*Primary Examiner* — Janine M Kreck

(57) ABSTRACT

A powered tile breaker has an adjustable frame and the frame is further comprised of a handlebar member, a foldable shaft, a base member, and wheels. The base member holds a chiseling assembly which comprises a main electric motor located inside a motor casing. The motor powers a chisel member. The chiseling assembly is angularly adjustable by way of an actuator member which consists in a secondary electric motor driving a piston. The piston has one end rotationally connected to the base member, and the actuator member is rotationally connected to a lever member which extends from the chiseling assembly and which connects at a pivot point.

8 Claims, 6 Drawing Sheets

FIG. 1B
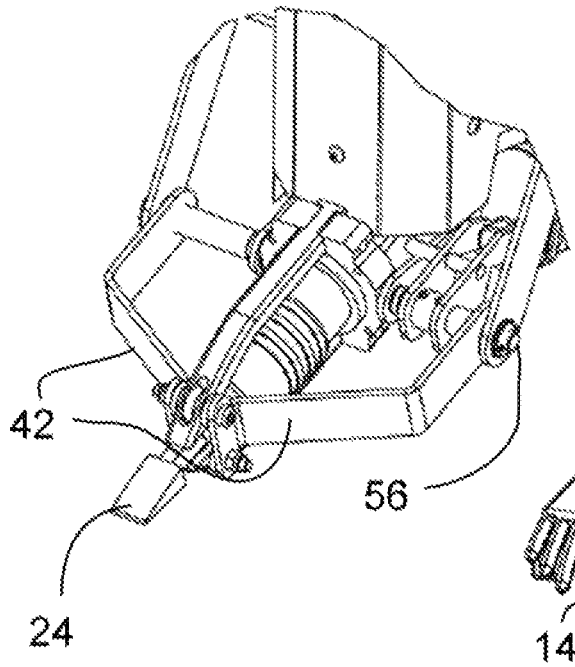
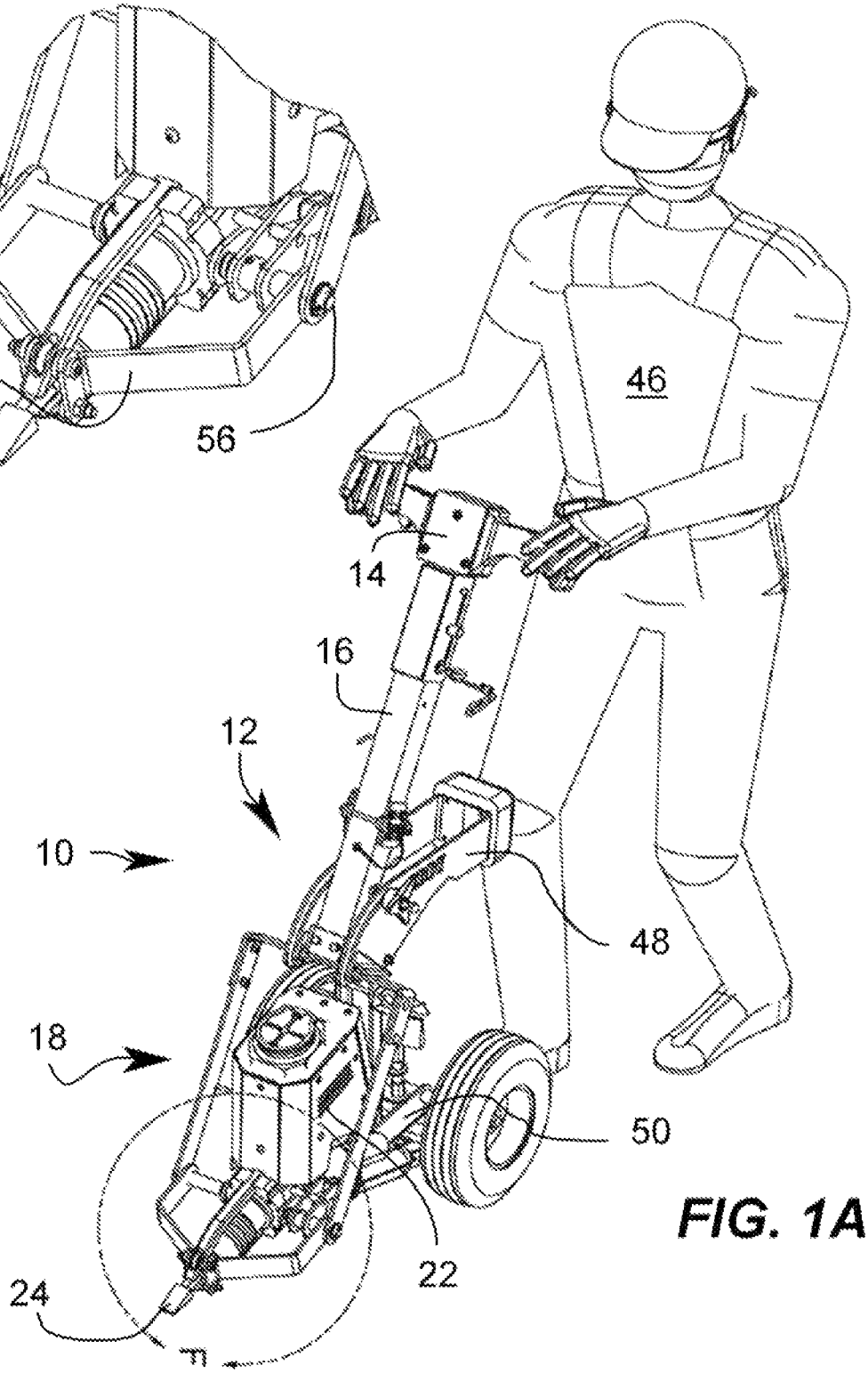
FIG. 1A

POWERED TILE BREAKER

FIELD OF THE INVENTION

The present invention relates generally to power tools but more particularly to a powered tile breaker.

BACKGROUND OF THE INVENTION

Breaking ceramic tiles is a very hard job and special chisels have been developed for that task. Still, doing that manually is hard and takes a long time. Powered devices have been developed over the years such as:

US20070228805 by Due which describes a power hammer apparatus including a cart and a power hammer arrangement mounted at a front region of the cart. The power hammer arrangement includes a reciprocating bit that contacts a working surface to break up the working surface as the power hammer is advanced by the power-driven cart.

U.S. Pat. No. 8,240,682 by Kennard describes a jackhammer trolley comprising a mainframe member with a clamp member at the bottom end and an extension bracket portion at the top end, a base frame member removably attached to the mainframe member by pivoting joints with at least one wheel member removably attached to its bottom, a handle member having a hand lever attached to said top end, and at least one vibration dampener fixed to said top or bottom end of the mainframe member.

There are several drawbacks and limitations the the prior art most notably in the possible adjustments which are limited to a few positions, which means that not every user can find an optimum ergonomic position in which to work, as not all sizes are covered. The machine of the prior art, lack some basic folding capabilities which can make the machine more compact for easy transportation even in a passenger car. Most importantly, the angle of the chisel is limited to specific angles that can only be modified prior to using the machine, not in use. Also, there are limitations in the adjustments, more particularly the handle part which may not be suitable for a wide range of user sizes.

SUMMARY OF THE INVENTION

In view of the foregoing disadvantages inherent in the known devices now present in the prior art, the present invention, which will be described subsequently in greater detail, is to provide objects and advantages which are:

To provide for a powered chiseling tool that is portable, and transportable. Various adjustments to keep the device in a most ergonomic fashion no matter the height of the user. A means of adjusting the angle of the chisel in a wide variety of angles, on the fly while operating the machine. A knee push member which lowers the center of gravity so that a user can keep his stability while giving the maximum pushing forward thrust to the machine should a patch of tiles be more difficult to remove.

In order to do so, the invention comprises an adjustable frame and the frame is further comprised of a handlebar member, a foldable shaft, a base member, and wheels. The base member holds a chiseling assembly which comprises a main electric motor located inside a motor casing. The motor powers a chisel member.

The chiseling assembly is angularly adjustable by way of an actuator member which consists in a secondary electric motor driving a piston. The piston has one end rotationally connected to the base member, and the actuator member is rotationally connected to a lever member which extends from the chiseling assembly and which connects at a pivot point.

The chiseling assembly is adjustable to any angles in a fluid and continuous range while the tile breaker in operating mode.

The angle adjustment mode is electrically controlled by way of a switch.

The angles are adjustable between 0 and 60 degrees.

A set of indicia, and an indicia pointer, located on the side of the motor casing serve as reference for indicating the angle of rotation of the motor casing as it pivots around the pivot point.

A stopper member for stopping the rotation of the chisel assembly.

The shaft has a hinge and lock means so that it can be folded.

The chiseling assembly has a "Y" shaped extension member to plow away broken tiles aside.

A knee push member acts as a low center of gravity secondary pushing point for pushing the tile breaker forward.

The shaft is adjustable angularly in combination with the angular adjustment of the chiseling assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiment of the invention.

BRIEF DESCRIPTION OF THE DRAWINGS

FIG. 1*a-b* Isometric view of the invention with a user and close up view of the chisel assembly.

DETAILED DESCRIPTION

Figure 2A:
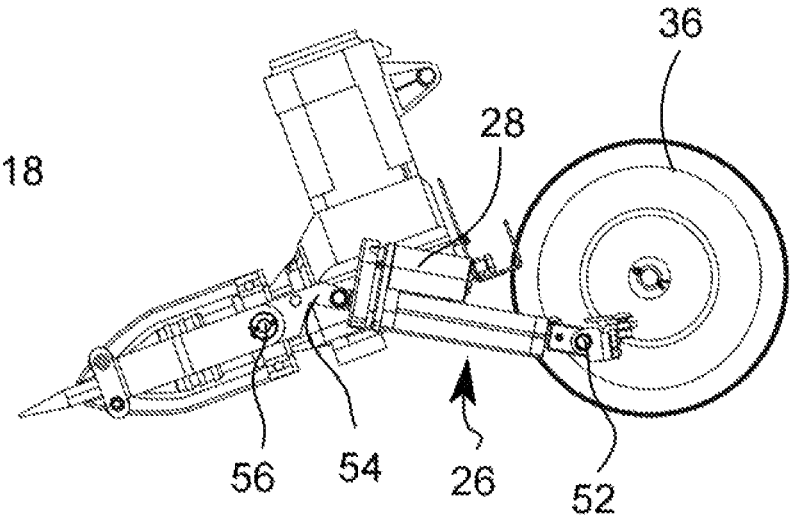
FIG. 2*a-b* Side views showing two angular configurations of the of the chisel assembly.
Figure 2B:
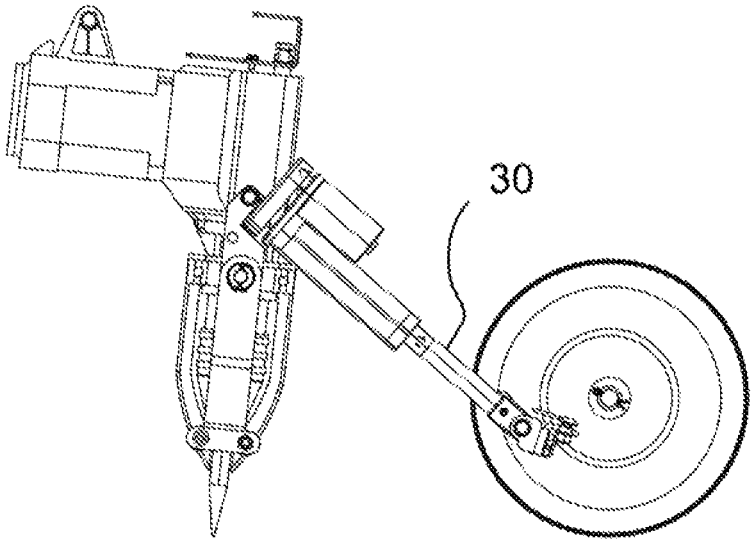
Figure 3A:
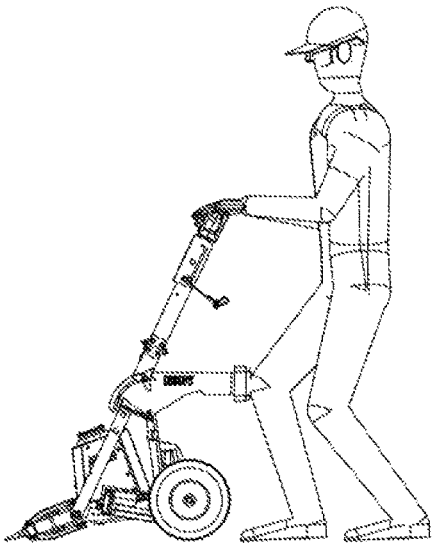
FIG. 3*a-d* Side views showing all adjustment angles.
Figure 3B:
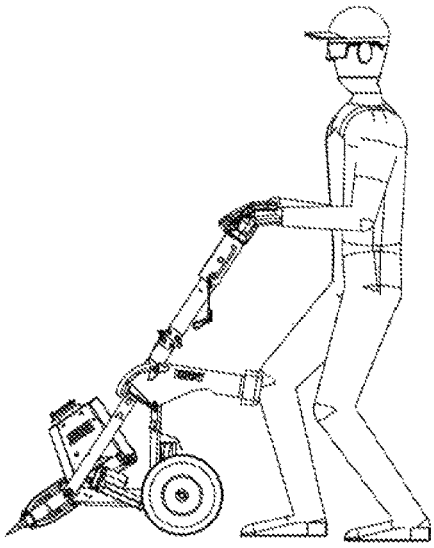
Figure 3C:
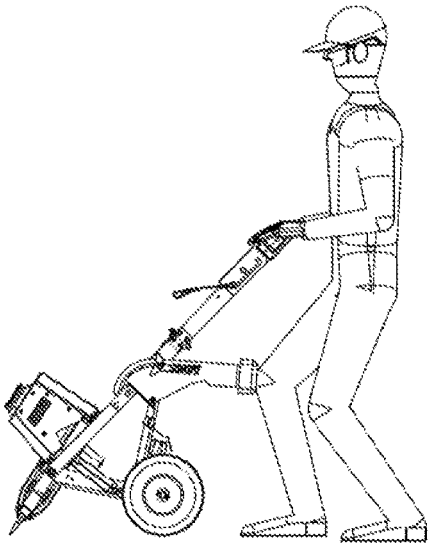
Figure 3D:
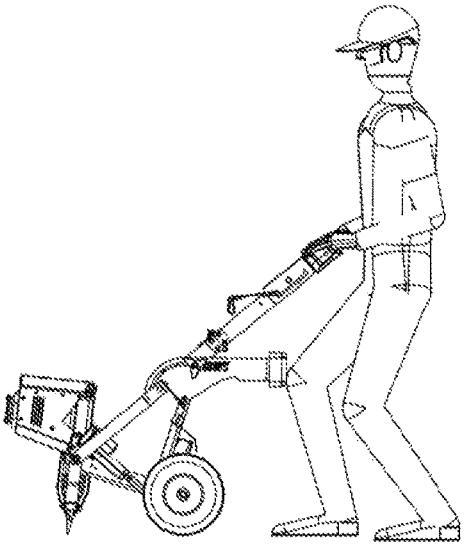
Figure 4A:
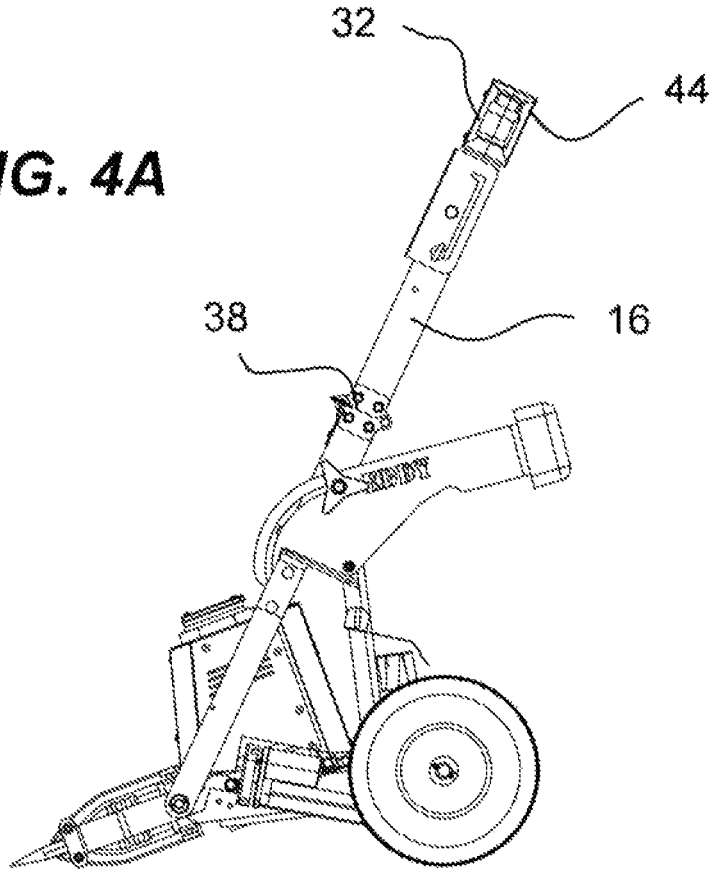
FIG. 4*a-b* Side views showing two shaft positions.
Figure 4B:
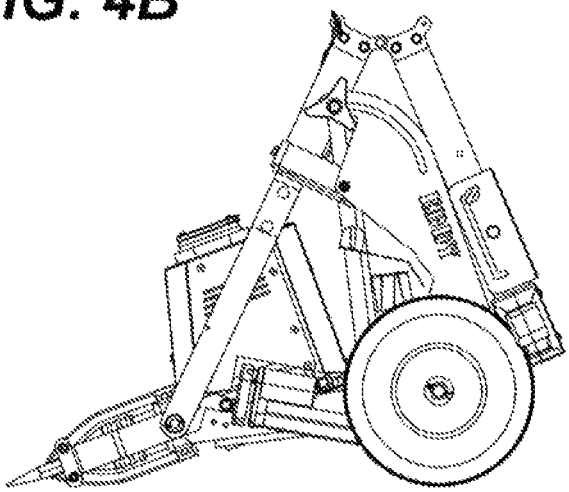
Figure 5:
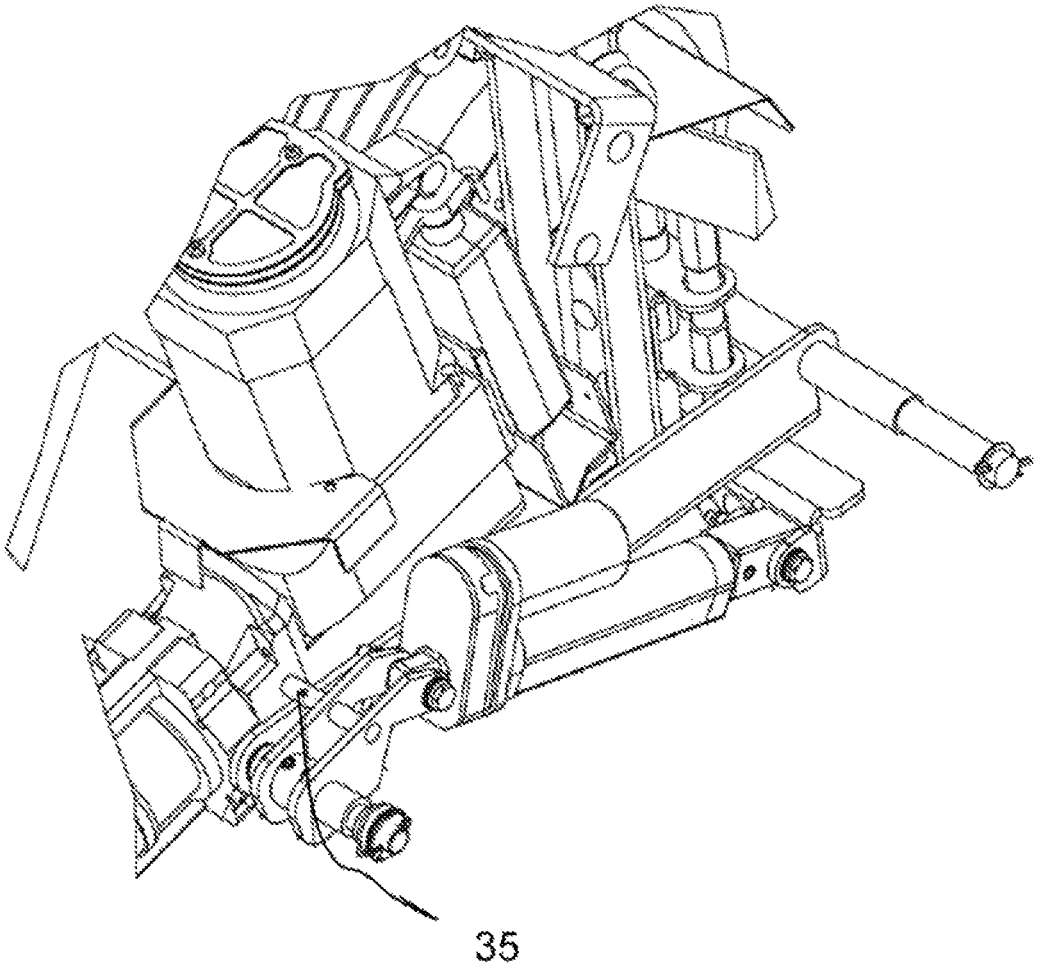
FIG. 5 Isometric view of the chisel assembly.
Figure 6:
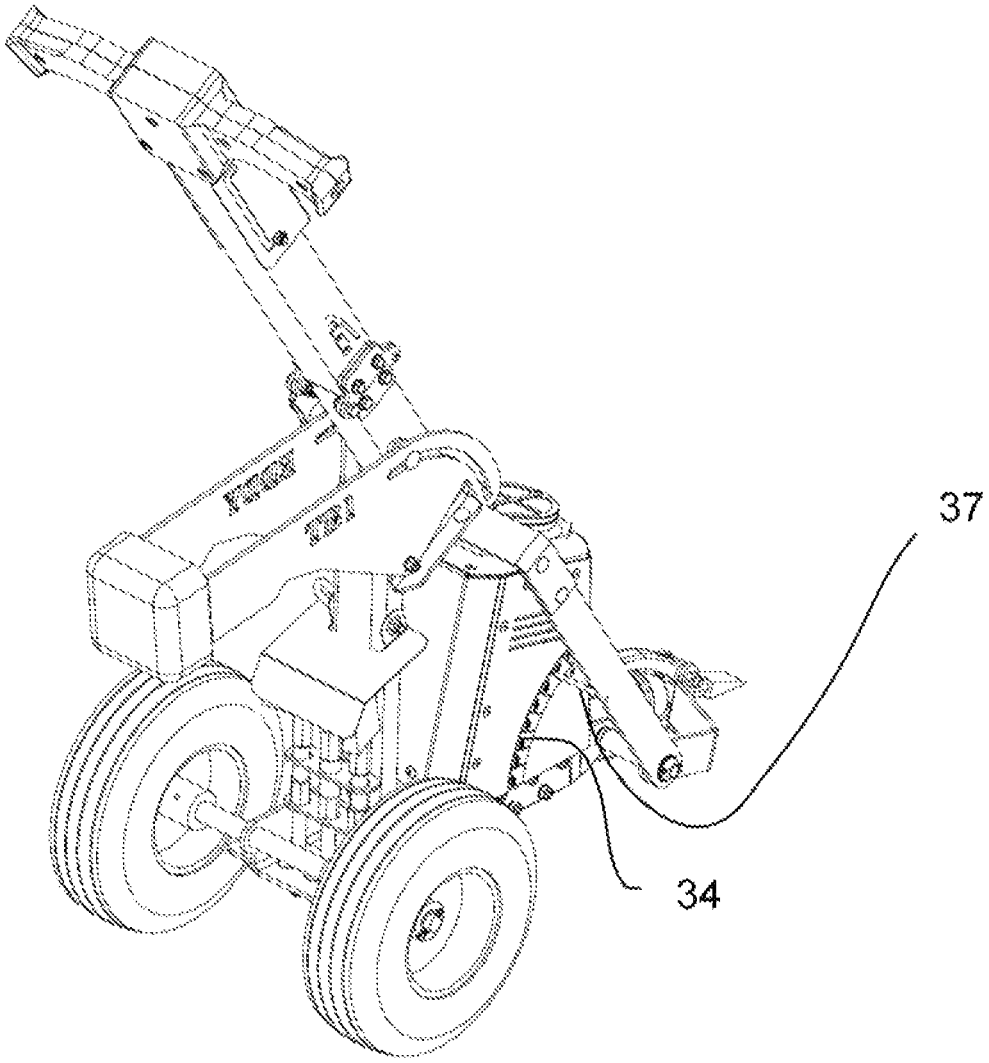
FIG. 6 Isometric view showing the adjustment means for the chiseling assembly.

A powered tile breaker (10) has an adjustable frame (12) having a handlebar member (14), a shaft (16), and wheels (36) to hold a chiseling assembly (18) which is comprised of a main electric motor (not shown), located inside a motor casing (22), and powers a chisel member (24) located at ground level.

The chiseling assembly (18) is angularly adjustable by way of an actuator member (26) which consists in a secondary electric motor (28) driving a piston (30). The piston (30) has one end rotationally connected to a base member (50), and the actuator member (26) is rotationally connected to a lever member (54) which extends from the chiseling assembly (18) and which connects at a pivot point (56).

This allows for the adjustment of the chiseling assembly (18) to any angles in a fluid and continuous range of between 0 to 60 degrees, while the tile breaker (10) is in operation. The adjustment means is controlled by a simple "up and down" button (32) located on the handlebar member (14).

A set of indicia (34), and an indicia pointer (37), located on the side of the motor casing is used as a reference to indicate the angle of rotation of the motor casing (22) as it pivots around the pivot point (56), and a stopper member (35) stops the rotation to prevent the chisel member (24) from pointing backwards.

The shaft (16) has a hinge and lock means (38) so that it can be folded in half for easy transportation in a small vehicle, for example.

The chiseling assembly (18) has a "Y" shaped extension member (42) which acts as a plow to push broken tiles aside. It also acts as the pivot point (56) for rotating the chiseling assembly (18).

There is, of course, a main on/off switch (44) on the handlebar member (14) to turn the tile breaker (10) on or off.

At the rear of the tile breaker, (10) and facing a user (46), is a knee push member (48) which allows for the user (46) to use his knees (one knee at a time) to further push the tile breaker (10) forward by exerting the upper body far less and as such, reduce stress related injury.

The shaft (16) can be adjusted angularly so as to provide a maximum level of adjustments so as to be customizable to any given user (46).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A powered tile breaker having an adjustable frame and said frame further comprised of a handlebar member, a foldable shaft, a base member, and wheels; said base member holding a chiseling assembly; said chiseling assembly comprising a main electric motor located inside a motor casing, said motor powering a chisel member; said chiseling assembly angularly adjustable by way of an actuator member which consists in a secondary electric motor driving a piston; said piston having one end rotationally connected to the base member, and said actuator member is rotationally connected to a lever member which extends from said chiseling assembly and which connects at a pivot point; a knee push member acting as a low center of gravity secondary pushing point for pushing said tile breaker forward.

2. The powered tile breaker of claim 1 wherein said chiseling assembly being adjustable to angles adjustable between 0 and 60 degrees in a fluid and continuous range while said tile breaker is in operating mode.

3. The powered tile breaker of claim 1 wherein said angle adjustment [being electrically controlled by way of a switch.

4. The powered tile breaker of claim 1 wherein a set of indicia, and an indicia pointer, located on the side of said motor casing serve as reference for indicating an angle of rotation of said motor casing as it pivots around said pivot point.

5. The powered tile breaker of claim 1 wherein said breaker also includes a stopper member for stopping said angularly adjustable chisel assembly.

6. The powered tile breaker of claim 1 wherein said shaft having a hinge and a means for locking so that it can be folded.

7. The powered tile breaker of claim 1 wherein said chiseling assembly having a "Y" shaped extension member to plow away broken tiles aside.

8. The powered tile breaker of claim 1 wherein said shaft is adjustable angularly in combination with the angular adjustment of said chiselling assembly.

* * * * *